US011006811B2

(12) United States Patent
Blackmon et al.

(10) Patent No.: US 11,006,811 B2
(45) Date of Patent: May 18, 2021

(54) RACK DETECTION SYSTEM FOR CHILD SAFETY AND A METHOD OF CONTROLLING A DISHWASHER

(71) Applicants: BSH Home Appliances Corporation, Irvine, CA (US); BSH Hausgeräte GmbH, Munich (DE)

(72) Inventors: Shane Blackmon, New Port, NC (US); Deborah Harr, New Bern, NC (US); Shaun Jones, New Bern, NC (US)

(73) Assignees: BSH Home Appliances Corporation, Irvine, CA (US); BSH Hausgeräte GmbH, Munich (DE)

( * ) Notice: Subject to any disclaimer, the term of this patent is extended or adjusted under 35 U.S.C. 154(b) by 129 days.

(21) Appl. No.: 16/414,803

(22) Filed: May 17, 2019

(65) Prior Publication Data

US 2020/0359872 A1 Nov. 19, 2020

(51) Int. Cl.
*A47L 15/00* (2006.01)
*A47L 15/50* (2006.01)

(52) U.S. Cl.
CPC ..... *A47L 15/0049* (2013.01); *A47L 15/50* (2013.01)

(58) Field of Classification Search
CPC ..... A47L 15/00–508
See application file for complete search history.

(56) References Cited

U.S. PATENT DOCUMENTS 8,025,743 B2 9/2011 Poyner et al.
8,192,551 B2 6/2012 Sundaram
8,277,571 B2 10/2012 Didat
8,734,594 B2 5/2014 Sundaram
9,198,556 B2 12/2015 Allen et al.
9,681,790 B2 6/2017 Sundaram
9,839,944 B2 12/2017 Kim et al.
9,844,801 B2 12/2017 Kim et al.
9,872,597 B2 1/2018 Pers et al.
2003/0192578 A1* 10/2003 Ochoa, Sr. ..... A47L 15/508 134/176
2006/0219262 A1* 10/2006 Peterson ..... A47L 15/4244 134/18
2006/0237052 A1 10/2006 Picardat et al.
(Continued)

FOREIGN PATENT DOCUMENTS

WO 2010059515 A1 5/2010

*Primary Examiner* — Michael E Barr
*Assistant Examiner* — Omair Chaudhri
(74) *Attorney, Agent, or Firm* — Michael E. Tschupp; Andre Pallapies; Brandon G. Braun

(57) ABSTRACT

A rack detection system for a dishwasher, including: a docking system including a plug disposed on a rack, such as a lower rack, and configured to dock with a docking hole of a water supply tube on condition that the lower rack is in an operational position within the dishwasher; and a controller configured to sense a load on the pump motor of a pump for pumping water to the water supply tube and determine if the load on the pump motor is within predetermined operating limits. On condition that the lower rack is removed from the operational position within the dishwasher and the plug is not docked with the water supply tube such that water flows out of the docking hole, the controller is configured to sense that the load on the pump motor is outside the predetermined operating limits and shuts down the dishwasher.

20 Claims, 7 Drawing Sheets

(56) References Cited

U.S. PATENT DOCUMENTS

| | | | | |
|---|---|---|---|---|
| 2010/0126526 | A1* | 5/2010 | Poyner | A47L 15/0049 134/18 |
| 2010/0170541 | A1* | 7/2010 | Poyner | A47L 15/0049 134/46 |
| 2011/0114140 | A1* | 5/2011 | Heisele | A47L 15/4291 134/56 D |
| 2017/0015595 | A1 | 1/2017 | Weaver et al. | |

* cited by examiner

*15 is a hole in the supply tube to provide adequate flow for detection

*16 is a plug designed to seal part 15 when part 14 is fully engaged.

RACK DETECTION SYSTEM FOR CHILD SAFETY AND A METHOD OF CONTROLLING A DISHWASHER

FIELD OF THE INVENTION

The present disclosure relates generally to dishwasher appliances and to racks for holding dishware and cutlery for a dishwasher. More particularly, the present disclosure relates to a rack detection system for child safety and to a method of controlling a dishwasher.

BACKGROUND OF THE INVENTION

In general, most domestic dishwasher appliances include two dishware racks disposed in a dishwashing compartment having a loading opening that is closable by a door. The dishware racks are configured to support items to be washed such as dishware, glassware, kitchen utensils, pots, pans, and the like. Typically, the two dishware racks include an upper dishware rack positioned near a top portion of the dishwasher, and a lower dishware rack arranged below the upper dishware rack. The upper dishware rack is used to support glassware, utensils, and other small items, while the lower dishware rack is used to support larger items, such as dinner plates, large bowls, cooking sheets, and baking pans. The dishware racks are normally formed from several discrete lengths of wire, welded together and then covered with a rubber or a plastic coating. Further, the dishware racks are formed with a plurality of vertically projecting tines to support and organize the items placed on the dishware rack. The lower dishware rack is typically supported by a plurality of rollers which roll on tracks formed in the side walls of the dishwashing compartment and the inner surface of the door and which allow the lower dishware rack to be moved out of and into the dishwashing compartment by the user. The dishwasher appliances also typically include at least one rotating sprayer arm in a tub.

With the above-described dishwasher appliance configuration, the possibility exists that a small child or small pet removes, for example, the lower dishware rack from the dishwashing compartment through the loading opening and crawls inside the dishwashing compartment into the tub. In such a situation, if the door somehow becomes closed and the dishwasher is actuated, it is possible that the child or pet becomes trapped inside and is injured. On the other hand, when the lower dishware rack is in its proper position, it serves to block or prevent a small child or small pet from gaining access to the tub area.

Current solutions for dealing with child safety issues include a system utilizing a time based requirement where the user/customer is required to press the start button of the dishwasher appliance and close the door before the maximum time has elapsed.

SUMMARY OF THE INVENTION

However, the above-noted child safety system solution utilizing the time based requirement prevents the full features of an internet connected appliance to be used. In particular, the current child safety system requires the user to press the start button and close the door before the maximum time has elapsed. This greatly hampers the internet connected (application based and controllable with a smart phone) controls, as it makes the user set up the dishwasher, turn it on and then the user can remotely start it.

Thus, if the user forgets to hit the start button before they leave the house, the user cannot use the remote start feature.

An apparatus consistent with the present disclosure is directed to providing a safety system for a dishwasher that is configured so as to allow for the full intended use of the home connect application.

An apparatus consistent with the present disclosure is directed to a rack detection system for child and pet safety.

An apparatus consistent with the present disclosure is directed to a system used to determine if the lower rack is in its proper "running" position or operational location. If the lower rack is in its proper running position, it can be determined that a child or small pet is not inside the dishwashing compartment or cavity of the dishwasher.

According to one aspect, the present disclosure provides a rack detection system for a dishwasher, the dishwasher comprising a water supply tube having at least one docking hole; a pump for pumping water to the water supply tube, the pump being driven by a pump motor; and a rack configured for movement out of and into the dishwasher, the rack detection system comprising: a docking system comprising at least one plug disposed on the rack and configured to dock with the at least one docking hole of the water supply tube on condition that the rack is in an operational position within the dishwasher; and a controller configured to sense a load on the pump motor of the pump for pumping water to the water supply tube and determine if the load on the pump motor is within predetermined operating limits, wherein, on condition that the rack is removed from the operational position within the dishwasher and the at least one plug is not docked with the water supply tube such that water flows out of the at least one docking hole, the controller is configured to sense that the load on the pump motor is outside the predetermined operating limits and shuts down the dishwasher.

According to another aspect, the dishwasher further comprises a water switch that is configured to be positioned such that water flows into the water supply tube, and wherein at a beginning of a wash cycle of the dishwasher, the controller is configured to position the water switch such that water flows into the water supply tube.

According to another aspect, the dishwasher further comprises an indicator to alert a user that the rack has been removed and that the dishwasher has been shut down.

According to another aspect, the indicator is at least one of a phone application/push notification, an auditory alarm, or a visual indicator.

According to another aspect, the pump motor is an electric motor and the controller is configured to sense an amp draw on the electric motor.

According to another aspect, the dishwasher further comprises a user interface in communication with the controller, and the user interface is configured to provide an indication that the rack has been removed from the operational position within the dishwasher.

According to another aspect, the rack comprises a lower rack, and the dishwasher further comprises at least one spray arm, wherein on condition that the lower rack is in the operational position within the dishwasher and the at least one plug on the lower rack is docked with the at least one docking hole of the water supply tube, water is prevented from flowing out of the at least one docking hole and the water is directed to the at least one spray arm.

According to another aspect, the present disclosure provides a dishwasher, comprising: a dishwashing compartment having a loading opening; a door configured to close the loading opening; a water supply tube having at least one docking hole; a pump for pumping water to the water supply tube, the pump being driven by a pump motor; a lower rack configured for movement out of and into the dishwashing compartment; and a lower rack detection system, the lower rack detection system comprising: a docking system comprising at least one plug disposed on the lower rack and configured to dock with the at least one docking hole of the water supply tube on condition that the lower rack is in an operational position within the dishwasher; and a controller configured to sense a load on the pump motor to determine if the load on the pump motor is within predetermined operating limits, wherein, on condition that the lower rack is removed from the operational position within the dishwasher and the at least one plug is not docked with the water supply tube such that water flows out of the at least one docking hole, the controller is configured to sense that the load on the pump motor is outside the predetermined operating limits and shuts down the dishwasher.

According to another aspect, the dishwasher further comprises a water switch that is configured to be positioned such that water flows into the water supply tube, and wherein at a beginning of a wash cycle of the dishwasher, the controller is configured to position the water switch such that water flows into the water supply tube.

According to another aspect, the dishwasher further comprises an indicator to alert a user that the lower rack has been removed and that the dishwasher has been shut down.

According to another aspect, the indicator is at least one of a phone application/push notification, an auditory alarm, or a visual indicator.

According to another aspect, the pump motor is an electric motor and the controller is configured to sense an amp draw on the electric motor.

According to another aspect, the dishwasher further comprises a user interface in communication with the controller, and the user interface is configured to provide an indication that the lower rack has been removed from the operational position within the dishwasher.

According to another aspect, the dishwasher further comprises at least one spray arm, wherein, on condition that the lower rack is in the operational position within the dishwasher and the at least one plug on the lower rack is docked with the at least one docking hole of the water supply tube, water is prevented from flowing out of the at least one docking hole and the water is directed to the at least one spray arm.

According to another aspect, the present disclosure provides a method of controlling a dishwasher, the dishwasher comprising a water supply tube having at least one docking hole; a pump for pumping water to the water supply tube, the pump being driven by a pump motor; a rack configured for movement out of and into the dishwasher; and at least one plug disposed on the rack and configured to dock with the at least one docking hole of the water supply tube on condition that the rack is in an operational position within the dishwasher, the method comprising: sensing a load on the pump motor of the pump for pumping water to the water supply tube and determining if the load on the pump motor is within predetermined operating limits; on condition that the rack is removed from the operational position within the dishwasher and the at least one plug is not docked with the water supply tube such that water flows out of the at least one docking hole, sensing that the load on the pump motor is outside the predetermined operating limits; and shutting down the dishwasher.

According to another aspect, the method further comprises alerting a user that the rack has been removed and that the dishwasher has been shut down.

According to another aspect, alerting the user comprises at least one of sending a phone application/push notification, sounding an auditory alarm, or activating a visual indicator.

According to another aspect, at a beginning of a wash cycle of the dishwasher, the method comprises positioning a water switch such that water flows into the water supply tube.

According to another aspect, the pump motor is an electric motor and the method comprises sensing the load on the pump motor comprise sensing an amp draw on the electric motor.

According to another aspect, the rack comprises a lower rack, and the method further comprises providing an indication that the lower rack has been removed from the operational position within the dishwasher via a user interface of the dishwasher.

BRIEF DESCRIPTION OF THE DRAWING FIGURES

The accompanying drawing figures incorporated in and forming a part of this specification illustrate several aspects of the invention, and together with the description serve to explain the principles of the invention.

Figure 7:
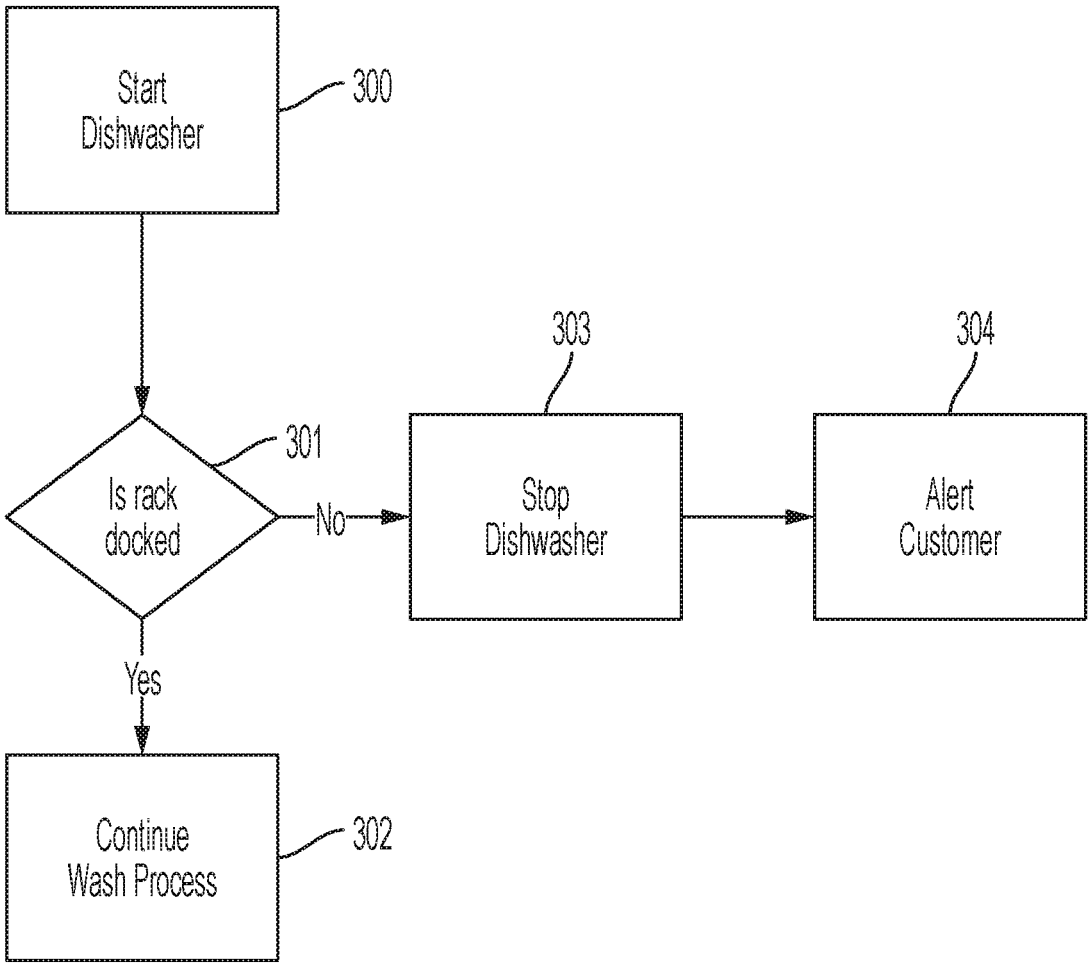
Figure 8:
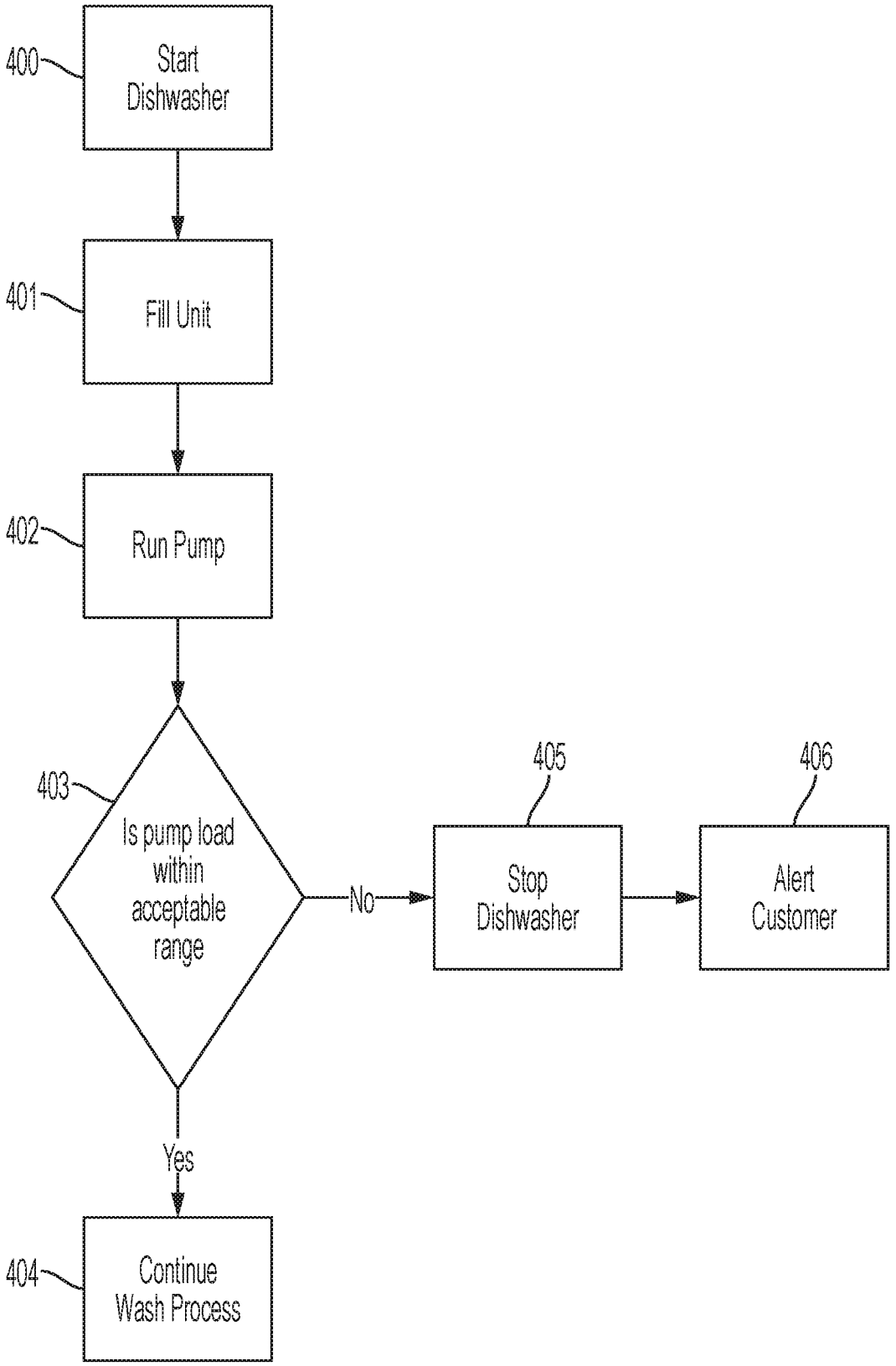

FIG. 7 is a simple flowchart diagram showing the operation of the dishwasher including the rack detection system for child safety according to an exemplary embodiment consistent with present disclosure; and FIG. 8 is a more detailed flowchart showing the operation of the dishwasher including the rack detection system for child safety according to an exemplary embodiment consistent with present disclosure.

DETAILED DESCRIPTION OF THE EXEMPLARY EMBODIMENTS

The exemplary embodiments set forth below represent the necessary information to enable those skilled in the art to practice the invention. Upon reading the following description in light of the accompanying drawing figures, those skilled in the art will understand the concepts of the invention and will recognize applications of these concepts not particularly addressed herein. It should be understood that these concepts and applications fall within the scope of the disclosure and the accompanying claims.

Moreover, it should be understood that terms such as top, bottom, front, rear, middle, upper, lower, right side, left side, vertical, horizontal, downward, upward, and the like used herein are for orientation purposes with respect to the drawings when describing the exemplary embodiments and should not limit the present invention unless explicitly indicated otherwise in the claims. Also, terms such as substantially, approximately, and about are intended to allow for variances to account for manufacturing tolerances, measurement tolerances, or variations from ideal values that would be accepted by those skilled in the art.

Figure 1:
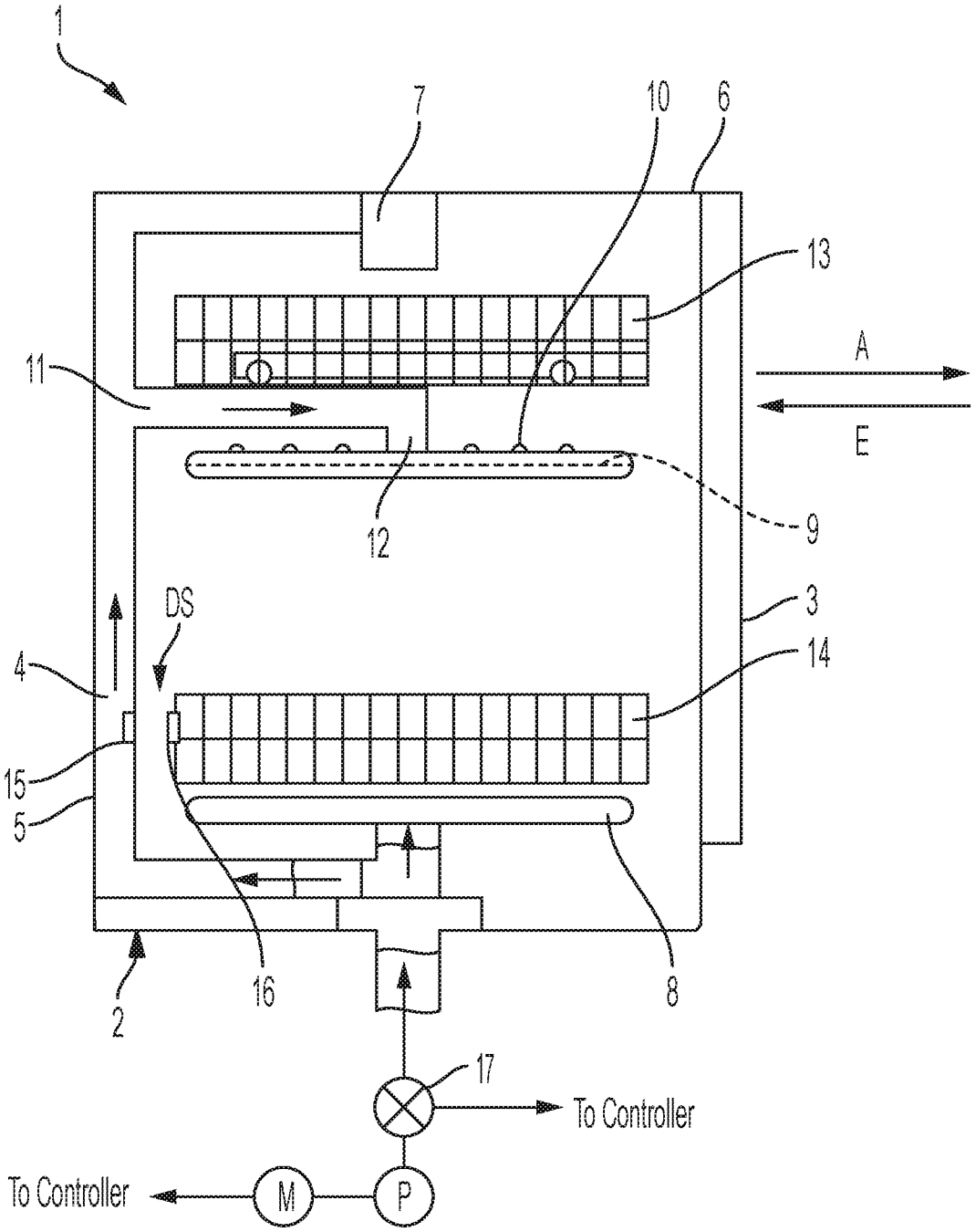
FIG. 1 is a schematic sectional view of a dishwasher appliance with the door closed according to an exemplary embodiment consistent with present disclosure.

FIG. 1 shows a significantly simplified schematic sectional view of an embodiment of a dishwasher appliance 1. The dishwasher appliance 1 is a domestic or home dishwasher. The dishwasher appliance 1 has a dishwashing compartment or dishwasher cavity 2 which can be enclosed in a water-tight manner by a door 3. A water supply tube or pipe 4 is arranged within the dishwasher cavity 2. The water supply tube 4 preferably runs along a rear wall 5 of the dishwasher cavity 2. Washing liquor or washing water can be applied to the water supply tube 4 with the aid of a circulation pump P that is driven by an electric motor M. The water supply tube 4 runs along the rear wall 5 and along a ceiling 6 of the dishwasher cavity 2. A roof spray apparatus 7 which is applied with washing liquor with the aid of the water supply tube 4 is provided on the ceiling 6.

A lower spray arm 8 and an upper spray arm 9 are also provided in the dishwasher cavity 2. The spray arms 8, 9 have spray nozzles 10, of which only one is provided with a reference character in FIG. 1. Spray nozzles provided on the lower spray arm 8 are not shown in FIG. 1. The lower spray arm 8 has spray nozzles arranged at least on the top side. The upper spray arm 9 can, in addition to the spray nozzles 10 provided on the top side, also have spray nozzles on the bottom side. The upper spray arm 9 is fastened rotatably on an inlet pipe 11. In particular, the inlet pipe 11 has a curved segment 12, which is curved downward by 90° relative to the inlet pipe 11. The upper spray arm 9 is fastened rotatably on the curved segment 12. While the present disclosure refers to lower and upper spray arms 8 and 9, the present disclosure also contemplates other configurations such as, but not limited to, washing systems such as a water wall or all jet nozzles that would not have to have a spray arm. Other washing systems are contemplated as long as the amp draw, for example, on the pump motor can be detected, as will be discussed in more detail below.

The dishwasher appliance 1 further has at least two receptacles such as washware racks or baskets 13, 14 for items to be washed provided in the dishwasher cavity 2. The receptacle 13 for items to be washed can be an upper rack or receptacle for items to be washed or a top basket of the dishwasher appliance 1 and the receptacle 14 for items to be washed can be a lower rack or receptacle for items to be washed or a bottom basket of the dishwasher appliance 1. Furthermore, the dishwasher appliance 1 can have a cutlery basket. The upper spray arm 9 is arranged between the receptacles 13, 14 for items to be washed. The receptacles 13, 14 for items to be washed can take the form of a wire grid or in particular a basket. With the aid of guide devices, not shown in FIG. 1, the racks or receptacles 13, 14 for items to be washed can be taken out of the dishwasher cavity 2 in a pull-out direction A when door 3 is opened and moved back into the dishwasher cavity 2 in an insertion direction E counter to the pull-out direction A. For example, the lower rack 14 can be disposed on rollers R (see FIGS. 2A, 3A, and 4A) that roll on tracks formed in the side walls of the dishwasher cavity 2 and on the inside of the door 3.

The inlet pipe 11 can be fastened to the upper receptacle 13 for items to be washed. A separable coupling can be provided between the inlet pipe 11 and the water supply tube 4 in order to permit a separation of the inlet pipe 11 from the water supply tube 4.

The above-described dishwasher appliance 1 is an example of a suitable configuration, but clearly other configurations are also possible as long as they have at least one rack that is removable from the dishwasher cavity 2.

As shown schematically in FIG. 1 and consistent with the present disclosure, at least one docking hole 15 is provided in the vertical portion of the water supply tube 4. The docking hole 15 is configured to provide adequate flow for detection, as will be described in more detail below. A docking system DS comprising at least one plug 16 disposed on the lower rack 14 and configured to dock with the docking hole 15 of the water supply tube 4 on condition that the lower rack 14 is in an operational position within the dishwasher cavity 2. While one docking hole 15 and one plug 16 are shown in the drawings, a plurality of docking holes and corresponding plugs are also contemplated by the present disclosure.

Figures 2A, 2B:
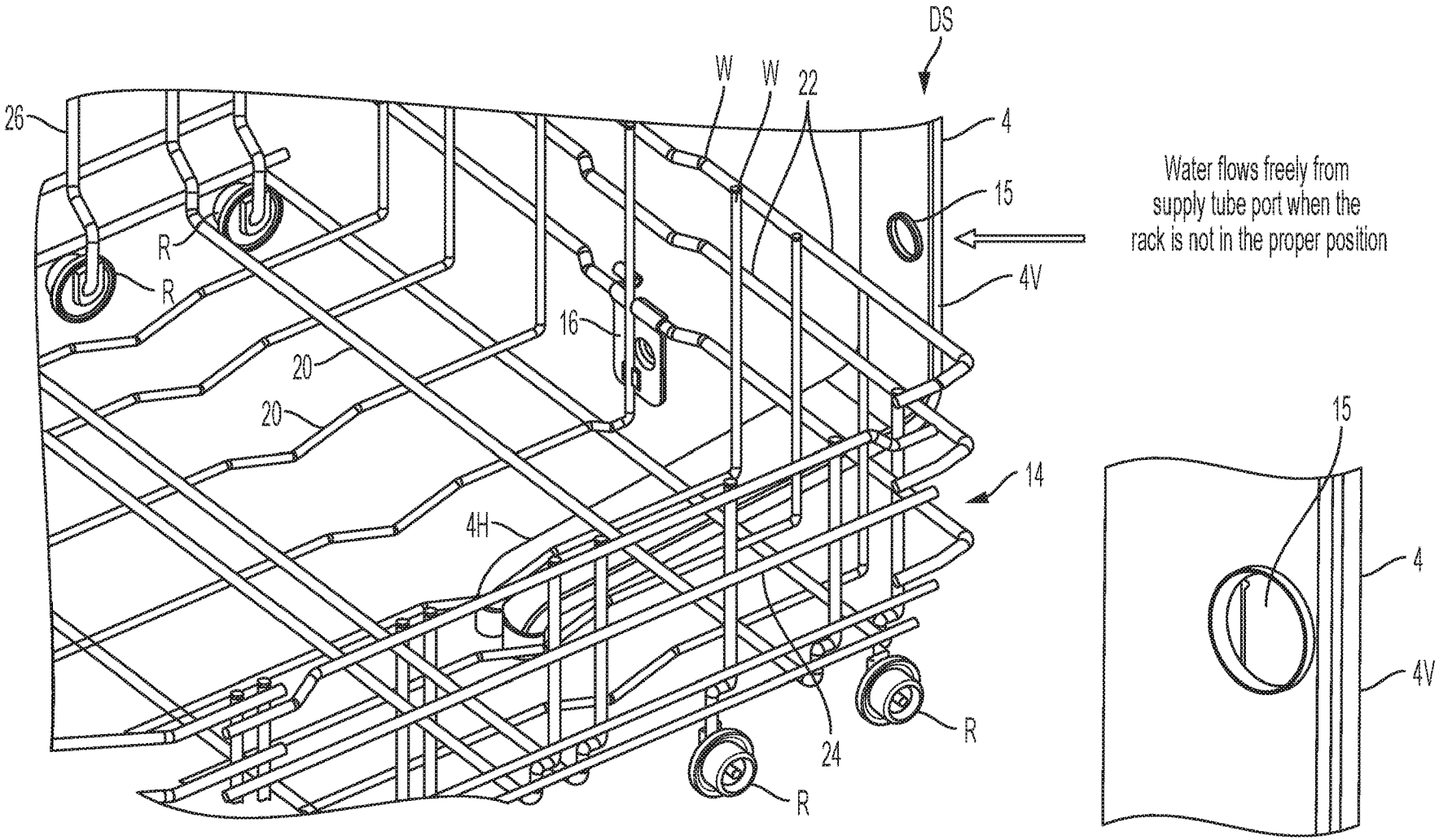
FIG. 2A is a fragmentary view of a lower rack in a pulled out condition such that the plug is not docked with the water supply tube according to an exemplary embodiment consistent with present disclosure.
FIG. 2B is a close up view of the docking hole in the water supply tube according to an exemplary embodiment consistent with present disclosure.
Figures 3A, 3B:
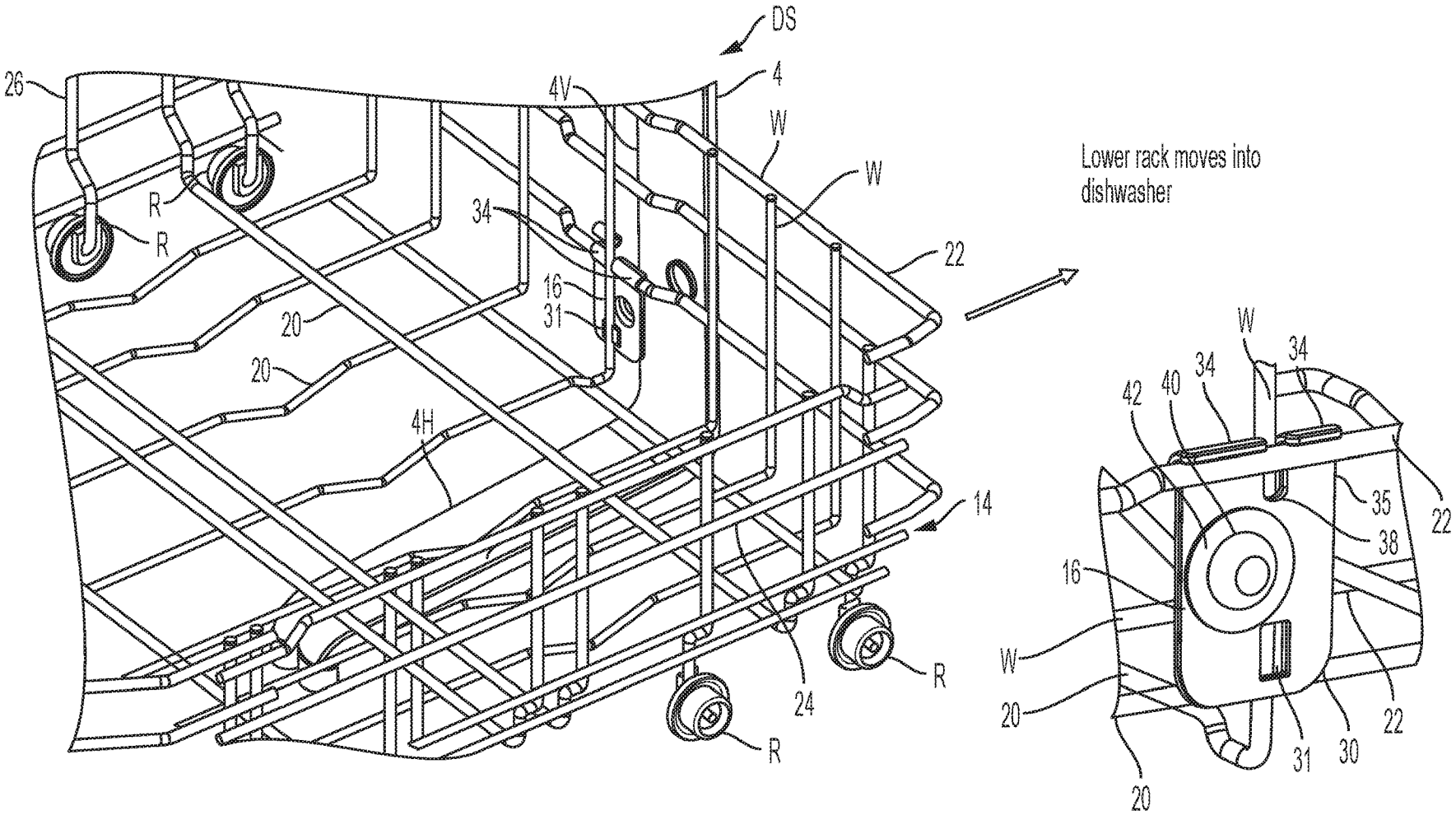
FIG. 3A is a fragmentary view of the lower rack moving into the dishwasher such that the plug is moving toward the water supply tube according to an exemplary embodiment consistent with present disclosure.
FIG. 3B is a close up view of the plug mounted on the rear wall of the rack according to an exemplary embodiment consistent with present disclosure.
Figure 4B:
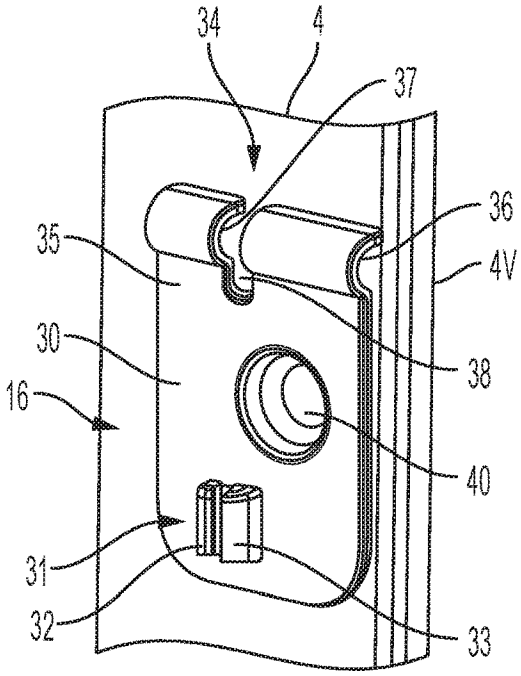
FIG. 4B is a close up of the plug per se in the docking position according to an exemplary embodiment consistent with present disclosure.
Figure 4A:
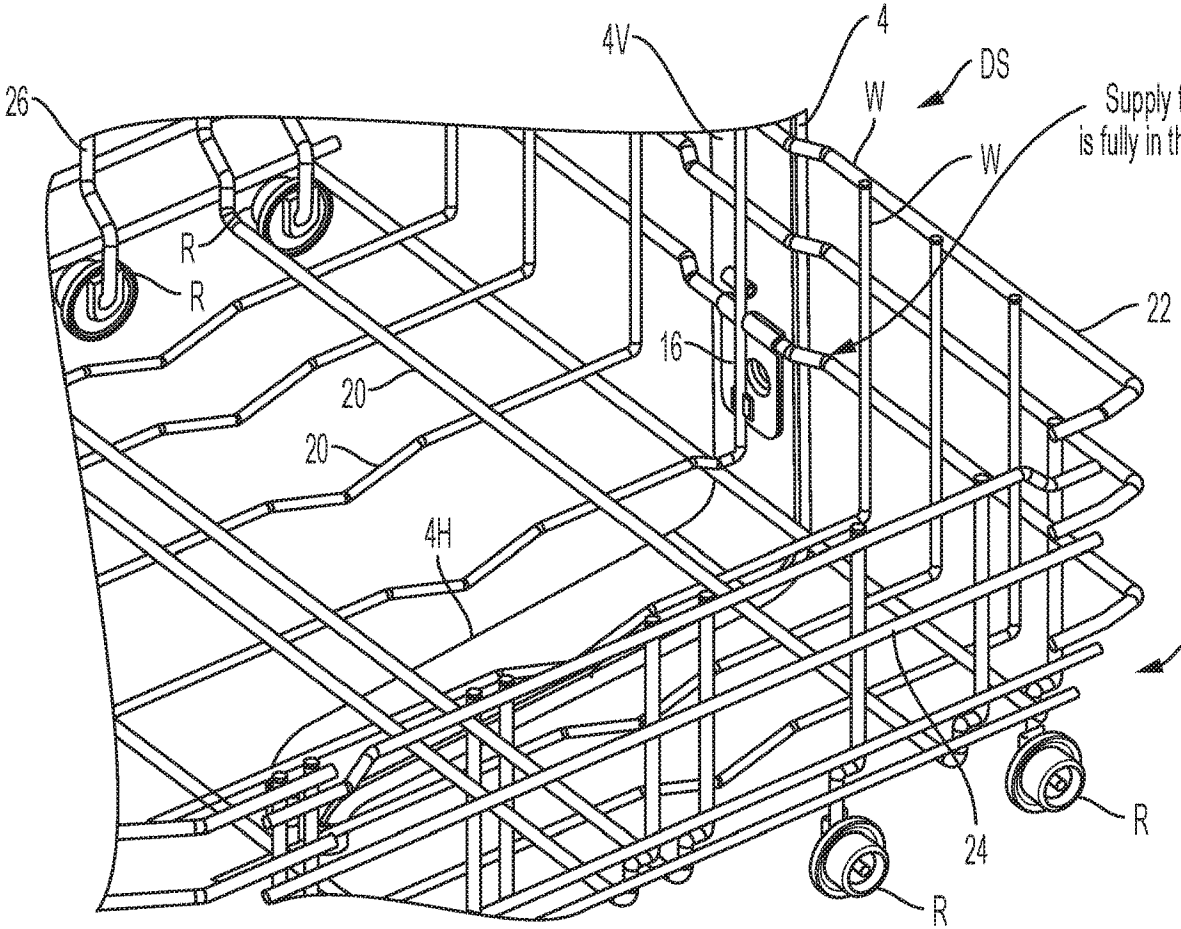
FIG. 4A is a fragmentary view of the lower rack disposed fully into the dishwasher in the proper position, such that the plug is sealed in the docking hole in the water supply tube according to an exemplary embodiment consistent with present disclosure.

FIGS. 2A, 2B, 3A, 3B, 4A, and 4B are views of the lower rack 14 and docking system DS in various states of operation, with the lower spray arm 8 removed for ease of understanding in FIGS. 2A, 3A, and 4A. In particular, FIG. 2A is a fragmentary view of the lower rack 14 in a pulled out condition with respect to the dishwasher cavity 2 such that the plug 16 is not docked with the docking hole 15 of the water supply tube 4 according to an exemplary embodiment consistent with present disclosure. The water supply tube 4 has a vertical portion 4V that has the docking hole 15 formed therein and a substantially horizontal portion 4H that turns down to connect to the circulation pump P. Between the circulation pump P and the water supply tube 4 is a directional device or water switch 17 that is used to control or direct where the water goes. This allows the user to run the roof spray apparatus 7, the lower spray arm 8, and the upper spray arm 9 to operate at different times or in a combination. The water supply tube 4 connects to this directional device 17.

The lower rack 14 is shown as formed of wire shaped elements W that are configured to have a basket shape with a bottom 20, a front wall (not visible in FIGS. 2A, 3A, and 4A), a rear wall 22, and right and left side walls 24, 26. The wire shaped elements may be formed of solid plastic, metal wire coated with plastic or rubber, or composite materials. The lower rack includes a plurality of the rollers R (only four of which are visible in FIGS. 2A, 3A, and 4A) disposed at a lower portion thereof.

With reference to FIGS. 2A, 3A, 4A, 3B, and 4B, the plug 16 is formed, for example, as a plate-shaped plastic piece 30 having a first clamping member 31 disposed on a side of the plate-shaped plastic piece 30 facing an interior of the lower rack 14. The first clamping member 31 can be configured as a pair of vertically extending arms 32 and 33 that snap over a vertical wire W of the rear wall 22 with an interference fit. The vertically extending arms 32 and 33 are shaped with a rounded inner curvature (see FIG. 4B) in order to snap with an interference fit over the vertical wire W of the rear wall 22. The plate-shaped plastic piece 30 also has a second clamping member 34 disposed at a top portion 35 of the plate-shaped plastic piece 30 facing an exterior of the lower rack 14. The second clamping member 34 can be configured as a pair of spaced apart horizontally extending grooves 36 and 37 that snap over a horizontal wire W of the rear wall 22 with an interference fit. The spaced apart horizontally extending grooves 36 and 37 have a gap 38 in between them formed at the top portion 35 of the plate-shaped plastic piece 30 in order to allow the vertical wire W of the rear wall 22 on which the first clamping member 31 is snapped to pass therethrough, as best shown in FIGS. 3A, 3B, and 4B. The spaced apart horizontally extending grooves 36 and 37 are shaped with a rounded inner curvature (see FIG. 4B) in order to snap with an interference fit over the horizontal wire W of the rear wall 22. The plate-shaped plastic piece 30 further has a projection 40 surrounded by, for example, a rubber seal or gasket 42. With reference to FIG. 3B, the projection 40 can have a circular cross-section and is configured to fit into the docking hole 15 when the lower rack 14 is fully in the dishwasher cavity 2 in the proper position. The projection 40 and rubber seal 42 together forms a water tight seal when the lower rack 14 is fully in the dishwasher cavity 2 in the proper position.

As best shown in FIG. 2B and as noted above, the docking hole 15 is provided in the vertical portion 4V of the water supply tube 4. The docking hole 15 is configured to provide adequate flow therethrough for detection of removal of the lower rack 14, such as by a small child or a small pet. The docking hole 15 is a hole that will sealingly receive the projection 40 when the lower rack 14 is fully in the dishwasher cavity 2 in the proper position.

With reference to FIGS. 5-8, a description will now be made of the dishwasher control including a rack detection system according to an exemplary embodiment consistent with present disclosure.

Figure 5:
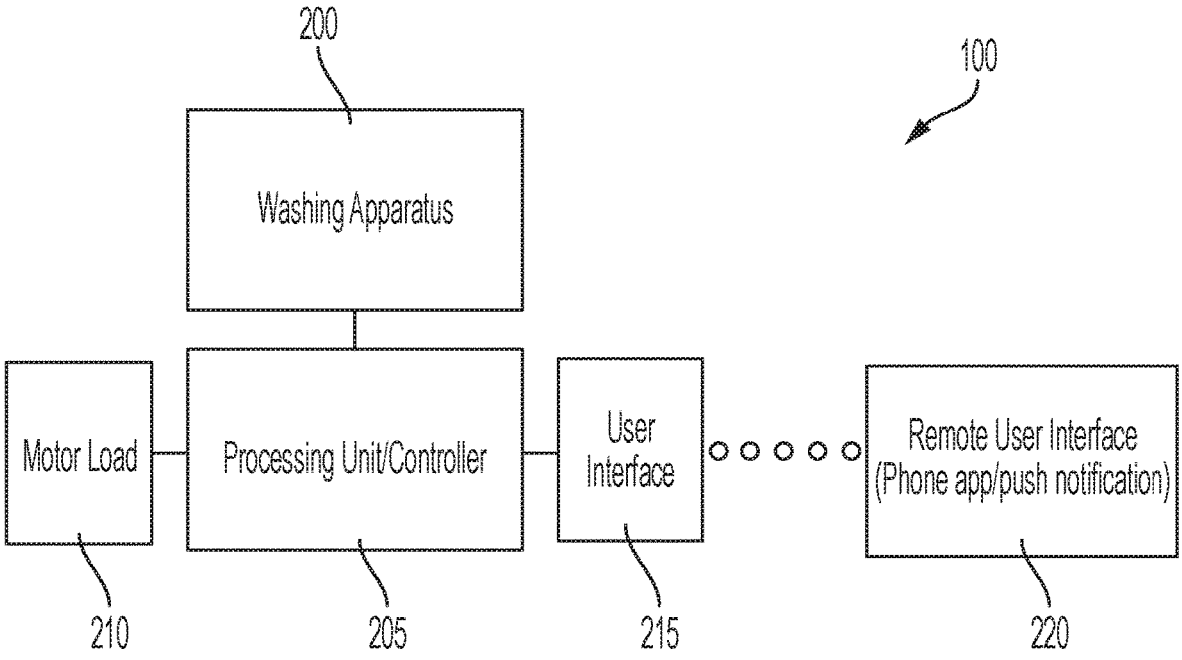
FIG. 5 is a block diagram of a dishwasher including a rack detection system according to an exemplary embodiment consistent with present disclosure.

FIG. 5 is a block diagram of a dishwasher including a rack detection system according to an exemplary embodiment consistent with present disclosure. In particular, the dishwasher 100 includes a washing apparatus 200 which is configured to control the supply of water to the dishwasher cavity 2 and can include the directional device or water switch 17 which leads to the water supply tube 4. The dishwasher 100 further includes a processing unit/controller 205 which is typically disposed in the door 3. The processing unit/controller 205 is configured to control the various wash cycles and communicates with the water switch 17 of the washing apparatus 200. The processing unit/controller 205 also communicates with the electric drive motor M of the circulation pump P (also referred to sometimes as the pump motor M) and is configured to sense a load on the electric drive motor M of the circulation pump P. Sensing of the load can be, but is not limited to, a sensing of the amp draw on the electric drive motor M of the circulation pump P. The processing unit/controller 205 also communicates with a user interface 215 which is typically located on the upper exterior portion of the door 3. A remote user interface 220 such as a smart phone using a phone application/push notification or other personal digital device can also be used to interface with the processing unit/controller 205.

Figure 6:
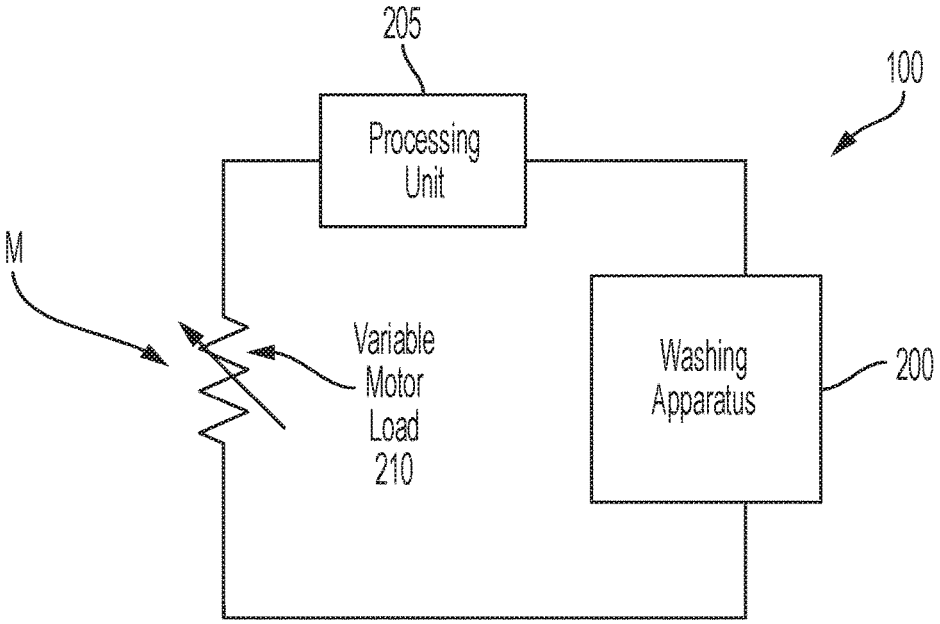
FIG. 6 is a block diagram of a dishwasher circuit including a rack detection system for child safety according to an exemplary embodiment consistent with present disclosure.

FIG. 6 is a block diagram of a dishwasher circuit including a rack detection system for child safety according to an exemplary embodiment consistent with present disclosure. In particular, the processing unit/controller 205 communicates with the washing apparatus 200 and with the electric drive motor M and is configured to sense a varying load 210 on the electric drive motor M of the circulation pump P. Consistent with the present disclosure, the processing unit/controller 205 is configured to sense a load on the pump motor to determine if the load on the pump motor M is within predetermined operating limits, such as at or above a predetermined lower limit and, on condition that the lower rack 14 is removed from the operational position within the dishwasher (1, 100) and the plug 16 is not docked with the water supply tube 4 such that water flows out of the docking hole 15, the processing unit/controller 205 senses that the load (e.g., the amp draw) on the pump motor M is outside the predetermined operating limits, such as lower than the predetermined lower limit and shuts down the dishwasher (1, 100).

FIG. 7 is a simple flowchart diagram showing the operation of the dishwasher including the rack detection system for child safety according to an exemplary embodiment consistent with present disclosure. In step 300, the user starts the dishwasher (1, 100) using either the user interface 215 on the dishwasher (1, 100) or the remote user interface 220. In step 301, the processing unit/controller 205 determines whether or not the lower rack 14 is docked. In particular, on condition that the lower rack 14 is fully in the dishwasher (1, 100) in the operational position within the dishwasher (1, 100) and the plug 16 is docked with the docking hole 15 of the water supply tube 4 such that water does not flow out of the docking hole 15 and into the dishwasher cavity 2, the processing unit/controller 205 determines that the load 210 (e.g., amp draw) on the pump motor M is above a predetermined lower limit. In that case, the dishwasher (1, 100) continues the wash process in step 302. On the other hand, on condition that the lower rack 14 is not docked and thus removed from the operational position within the dishwasher (1, 100) and the plug 16 is not docked with the docking hole 15 of the water supply tube 4 such that water flows out of the docking hole 15, the processing unit/controller 205 senses that the load 210 on the pump motor M is lower than the predetermined lower limit (e.g., the amp draw on the pump motor M is lower than specified). In that case, the processing unit/controller 205 shuts down the dishwasher (1, 100) in step 303. In step 304, the processing unit/controller 205 activates an indicator to alert a user that the lower rack 14 has been removed and that the dishwasher (1,100) has been shut down. The indicator can be one or a combination of a phone application/push notification (connected appliance), an auditory alarm, or a visual indicator, such as a light emitting diode (LED), liquid crystal display (LCD), or thin-film transistor (TFT), that is, for example, part of the user interface 215 and/or remote user interface 220. In this way, if a small child or a small pet, for example, removes the lower rack 14 from the dishwasher cavity 2 through the loading opening and crawls inside the dishwasher cavity 2 into the tub, the plug 16 is not docked with the docking hole 15 of the water supply tube 4 such that water flows out of the docking hole 15, the processing unit/controller 205 senses that the load 210 on the pump motor M is lower than the predetermined lower limit and thus the lower rack 14 is not in its proper position and stops the dishwasher (1,100) and alerts the consumer/user.

FIG. 8 is a more detailed flowchart showing the operation of the dishwasher (1,100) including the rack detection system for child safety according to an exemplary embodiment consistent with present disclosure. In step 400, the user starts the dishwasher (1, 100) using either the user interface 215 on the dishwasher (1, 100) or the remote user interface 220. In step 401, the processing unit/controller 205 instructs the washing apparatus 200 to supply water to the dishwasher cavity 2 in order to fill the unit at a beginning of a wash cycle of the dishwasher (1, 100) by positioning the water switch 17 such that water flows into the water supply tube 4. In step 402, the processing unit/controller 205 instructs the electric motor M of the circulation pump P to run and pump water to the one or more of the roof spray apparatus 7, the lower spray arm 8, or the upper spray arm 9 as directed by the water switch 17. In step 403, the processing unit/controller 205 determines whether or not the load on the electric drive motor M of the pump P is within an acceptable range which in turn indicates if the lower rack 14 is docked. In particular, on condition that the lower rack 14 is fully in the dishwasher (1, 100) in the operational position within the dishwasher (1, 100) and the plug 16 is docked with the docking hole 15 of the water supply tube 4 such that water does not flow out of the docking hole 15 and into the dishwasher cavity 2, the processing unit/controller 205 determines that the load 210 on the pump motor M is above a predetermined lower limit. In that case, the dishwasher (1, 100) continues the wash process in step 404. On the other hand, on condition that the lower rack 14 is not docked and thus removed from the operational position within the dishwasher (1, 100) and the plug 16 is not docked with the docking hole 15 of the water supply tube 4 such that water flows out of the docking hole 15, the processing unit/controller 205 senses that the load 210 on the pump motor M is lower than the predetermined lower limit. In that case, the processing unit/controller 205 shuts down the dishwasher (1, 100) in step 405. In step 406, the processing unit/controller 205 activates an indicator to alert a user that the lower rack 14 has been removed and that the dishwasher (1, 100) has been shut down.

Note that at times the system or processing unit/controller of the present disclosure is described as performing a certain function. However, one of ordinary skill in the art would know that the program is what is performing the function rather than the entity of the system itself.

Although aspects of one implementation of the present disclosure are depicted as being carried out by the controller 205 and includes software being stored in memory, one skilled in the art will appreciate that all or part of systems and methods consistent with the present invention may be stored on or read from other non-transitory computer-readable media, such as secondary storage devices, like hard disks, floppy disks, and CD-ROM, or other forms of a read-only memory (ROM) or a random access memory (RAM) either currently known or later developed. Further, although specific components of the system have been described, one skilled in the art will appreciate that a system suitable for use with the methods and systems consistent with the present disclosure may contain additional or different components.

The present invention has substantial opportunity for variation without departing from the spirit or scope of the present invention. For example, while the load sensed on the pump motor M is described as the amp draw as sensed by the processing unit/controller, the load could be sensed in other ways, such as by directly sensing the current of the pump motor M using a current sensor such as a Hall Effect sensor. Moreover, while the present disclosure describes the docking system DS being used with a lower rack 14, the present disclosure also contemplates other configurations. For example, but not limited to, a configuration where a cutlery drawer or basket is disposed between the upper rack and the lower rack and the cutlery drawer is in a position to assure that a child does not fit inside the dishwasher cavity when such a cutlery drawer or basket is in its proper operational position. Also contemplated is a smaller dishwasher unit that has only one rack but is still big enough to fit a child without the rack being in its proper operational position. The present disclosure also contemplates using the docking system DS on an upper rack or a combination of various racks. Also, the various features described in connection with a particular embodiment can be used (mixed and matched) with the other embodiments wherever appropriate.

Those skilled in the art will recognize improvements and modifications to the exemplary embodiments of the present invention. All such improvements and modifications are considered within the scope of the concepts disclosed herein and the claims that follow.

What is claimed is:

1. A rack detection system a dishwasher, the dishwasher comprising a water supply tube having at least one docking hole; a pump for pumping water to the water supply tube, the pump being driven by a pump motor; and a rack configured for movement out of and into the dishwasher, the rack detection system comprising:

a docking system comprising at least one plug disposed on the rack and configured to dock with the at least one docking hole of the water supply tube on condition that the rack is in an operational position within the dishwasher thereby preventing the flow of water from the at least one docking hole; and a controller configured to sense a load on the pump motor of the pump for pumping water to the water supply tube and determine if the load on the pump motor is within predetermined operating limits, wherein, on condition that the rack is removed from the operational position within the dishwasher and the at least one plug is not docked with the water supply tube such that water flows out of the at least one docking hole during operating of the dishwasher, the controller is configured to sense that the load on the pump motor is outside of the predetermined operating limits and shuts down the dishwasher.

2. The rack detection system of claim 1, wherein the dishwasher further comprises a water switch that is configured to be positioned such that water flows into the water supply tube, and wherein at a beginning of a wash cycle of the dishwasher, the controller is configured to control the water switch to open such that water flows into the water supply tube.

3. The rack detection system of claim 1, wherein the dishwasher further comprises an indicator to alert a user that the rack has been removed and that the dishwasher has been shut down.

4. The rack detection system of claim 3, wherein the indicator is at least one of a phone application/push notification, an auditory alarm, or a visual indicator.

5. The rack detection system of claim 1, wherein the pump motor is an electric motor and the controller is configured to sense an amp draw on the electric motor.

6. The rack detection system of claim 1, wherein the dishwasher further comprises a user interface in communication with the controller, and the user interface is configured to provide an indication that the rack has been removed from the operational position within the dishwasher.

7. The rack detection system of claim 1, wherein the rack comprises a lower rack, wherein the dishwasher further comprises at least one spray arm, and wherein on condition that the lower rack is in the operational position within the dishwasher and the at least one plug on the lower rack is docked with the at least one docking hole of the water supply tube, water is prevented from flowing out of the at least one docking hole and the water is directed to the at least one spray arm.

8. A dishwasher, comprising:

a dishwashing compartment having a loading opening;

a door configured to close the loading opening;

a water supply tube having at least one docking hole;

a pump for pumping water to the water supply tube, the pump being driven by a pump motor;

a lower rack configured for movement out of and into the dishwashing compartment; and a lower rack detection system, the lower rack detection system comprising:

a docking system comprising at least one plug disposed on the lower rack and configured to dock with the at least one docking hole of the water supply tube on condition that the lower rack is in an operational position within the dishwasher thereby preventing the flow of water from the at least one docking hole; and a controller configured to sense a load on the pump motor to determine if the load on the pump motor is within predetermined operating limits, wherein, on condition that the lower rack is removed from the operational position within the dishwasher and the at least one plug is not docked with the water supply tube such that water flows out of the at least one docking hole during operation of the dishwasher, the controller is configured to sense that the load on the pump motor is outside of the predetermined operating limits and shuts down the dishwasher.

9. The dishwasher of claim 8, wherein the dishwasher further comprises a water switch that is configured to be positioned such that water flows into the water supply tube, and wherein at a beginning of a wash cycle of the dishwasher, the controller is configured to control the water switch to open such that water flows into the water supply tube.

10. The dishwasher of claim 8, wherein the dishwasher further comprises an indicator to alert a user that the lower rack has been removed and that the dishwasher has been shut down.

11. The dishwasher of claim 10, wherein the indicator is at least one of a phone application/push notification, an auditory alarm, or a visual indicator.

12. The dishwasher of claim 8, wherein the pump motor is an electric motor and the controller is configured to sense an amp draw on the electric motor.

13. The dishwasher of claim 8, wherein the dishwasher further comprises a user interface in communication with the controller, and the user interface is configured to provide an indication that the lower rack has been removed from the operational position within the dishwasher.

14. The dishwasher of claim 8, further comprising at least one spray arm, wherein, on condition that the lower rack is in the operational position within the dishwasher and the at least one plug on the lower rack is docked with the at least one docking hole of the water supply tube, water is prevented from flowing out of the at least one docking hole and the water is directed to the at least one spray arm.

15. A method of controlling a dishwasher, the dishwasher comprising a water supply tube having at least one docking hole; a pump for pumping water to the water supply tube, the pump being driven by a pump motor; a rack configured for movement out of and into the dishwasher; and at least one plug disposed on the rack and configured to dock with the at least one docking hole of the water supply tube on condition that the rack is in an operational position within the dishwasher thereby preventing the flow of water from the at least one docking hole, the method comprising:

sensing a load on the pump motor of the pump for pumping water to the water supply tube and determining if the load on the pump motor is within predetermined operating limits;

on condition that the rack is removed from the operational position within the dishwasher and the at least one plug is not docked with the water supply tube such that water flows out of the at least one docking hole during operation of the dishwasher, sensing that the load on the pump motor is outside the predetermined operating limits; and shutting down the dishwasher.

16. The method of claim 15, further comprising alerting a user that the rack has been removed and that the dishwasher has been shut down.

17. The method of claim 16, wherein alerting the user comprises at least one of sending a phone application/push notification, sounding an auditory alarm, or activating a visual indicator.

18. The method of claim 15, wherein at a beginning of a wash cycle of the dishwasher, positioning a water switch such that water flows into the water supply tube.

19. The method of claim 15, wherein the pump motor is an electric motor and the sensing the load on the pump motor comprise sensing an amp draw on the electric motor.

20. The method of claim 15, wherein the rack comprises a lower rack, and further comprising providing an indication that the lower rack has been removed from the operational position within the dishwasher via a user interface of the dishwasher.

* * * * *